United States Patent [19]

Warren et al.

[11] 4,247,766

[45] Jan. 27, 1981

[54] DEMAND ILLUMINATION CONTROL APPARATUS

[76] Inventors: Carl Warren, 944 Varr Ave., Rockledge, Fla. 32955; Jimmie Arline, 1614 Kingswood Dr., Lansing, Mich. 48912; Julius LaPalme, 2830 Friday La., Cocoa, Fla. 32922

[21] Appl. No.: 3,486

[22] Filed: Jan. 12, 1979

[51] Int. Cl.[3] ..... H01J 40/14

[52] U.S. Cl. ..... 250/214 AL; 315/154

[58] Field of Search ..... 315/151, 154, 158; 250/20 S, 214 R, 214 AL

[56] References Cited

U.S. PATENT DOCUMENTS

| | | | |
|---|---|---|---|
| 2,269,324 | 1/1942 | Turner et al. | 315/151 |
| 3,603,799 | 9/1971 | Nobusawa | 315/154 |
| 3,665,224 | 5/1972 | Kelsey | 250/214 AL |
| 4,122,334 | 10/1978 | Owens | 250/214 AL |

*Primary Examiner*—David C. Nelms

*Attorney, Agent, or Firm*—Richard M. Saccocio

[57] ABSTRACT

Solar illuminating compensating apparatus is disclosed whereby the interior of a building is illuminated to a substantially constant, predetermined level of light intensity by a combination of natural illumination from the sun and artificial illumination from electricity wherein the intensity of said artificial illumination is controlled by fully electronic means which increases the level of artificial illumination when the natural illumination is inadequate and vice versa.

11 Claims, 5 Drawing Figures

DEMAND ILLUMINATION CONTROL APPARATUS

ORIGIN OF THE INVENTION

The rights to the instant application have been awarded by NASA to the above-named inventors who comprise a small business minority firm doing business as WARREN AND WILLIAMS ASSOCIATES of Titusville, Fla., in accordance with their Petition for Waiver of Domestic Rights to an Identified Invention under Section 1245.105 of the NASA Patent Waiver Regulations, which Petition was duly granted by NASA.

CROSS REFERENCES TO RELATED APPLICATIONS

This application is related to the pending application of Lester J. Owens (an employee of the United States Government) Ser. No. 753,977, filed Dec. 23, 1976, U.S. Pat. No. 4,122,334 entitled *ILLUMINATION CONTROL APPARATUS FOR COMPENSATING SOLAR LIGHT,* which application and the instant application were derived from separate but related contracts awarded by NASA.

BACKGROUND OF THE INVENTION

1. Field of the Invention

This invention relates, in general, to the class of inventions having as a primary object the savings of energy derived from fossil or fissile fuels and in particular to electrical energy savings apparatus designed for illumination.

2. Description of the Prior Art

The unbridled use of electrical energy is no longer possible. The United States of America is already too dependent upon our foreign neighbors for our supply of oil. The use of our abundant reserves of coal is not presently feasible because the hazards produced by pollution necessitate that it be made clean prior to burning and pollution-free coal is not as economical as the present high price of gas or oil. Nuclear power is similarly disadvantageous because of the radioactive waste disposal problem, which seemingly is unsolvable. New and efficient means to conserve energy must be discovered, invented and implemented now. The instant invention and the apparatus disclosed herein has been shown to be an effective means to conserve energy. In addition, its implementation will result in a significant cost saving to both business and the consumer as well as the government of the United States of America, the governments of the individual states and their political subdivisions.

During the early stages of civilization, natural illumination from solar energy was, of course, the only source of light that was available. The discovery or invention of fire and the illumination produced thereby aided man in his quest to light up the darkness which existed during the non-daylight hours or during daylight hours in areas where natural illumination did not sufficiently penetrate. The invention of electricity coupled with the inventions of the various types of light bulbs seemed to answer man's problem of achieving adequate illumination. For reasons detailed above, the present energy shortage and man's increasing need for energy has caused the problems associated with adequate illumination to resurface. The main problem being the supplying of adequate illumination while conserving as much energy as possible.

Modern architects have recognized and addressed the need to conserve energy in the design of new office buildings. For example, many new buildings utilize the heat produced by the people occupying the building and the heat produced by the illuminating system to provide heat for the building in the winter months. Then too, in southern regions, architects use cool-burning light fixtures to decrease the demand on air-conditioning within the building. Window coatings and even glass have been invented and used to either reflect or absorb the sun's thermal energy depending on whether it is desired to heat or cool the building. However, very little has been accomplished in the field of illumination as regards utilizing the combination of natural light and artificial light to decrease the cost of artificial illumination and to conserve energy.

A simple survey of old buildings as might be used for offices or new, modern buildings will disclose that no light-control devices or apparatus are utilized, notwithstanding the abundant illumination available from natural sources. One reason attributable to this non-use is because there is no prior art device or apparatus which is sufficiently sophisticated so as to be capable of effectively being utilized for this purpose.

Illumination control systems have, of course, been disclosed and developed in the past, but these are primarily concerned with turning a light fixture on or off. The invention of Dubot, et al in U.S. Pat. No. 3,961,183, issued June 1, 1976, is an example of such a device. There, Dubot, et al, disclosed a light responsive electric switch utilizing a motor having stepped-down gearing to activate street lighting. The invention of Bolhuis, in U.S. Pat. No. 3,863,104, Jan., 1975, is another such example. The Bolhuis invention being concerned with assuring a minimum amount of light from tunnel lights in the event that a failure occurs in the main apparatus turning the lights on.

The invention of Dewan in U.S. Pat. No. 2,199,394, May, 1940, *LIGHT CONTROL SYSTEM* tends to address the problem of saving energy by using a combination of natural light and artificial light in a structure. However, the relatively simplistic but direct approach of Dewan falls short of the need for a reliable, economical, precise system. Also, a main disadvantage of Dewan's invention is that it would be sensitive to phenomena such a lightning. Dewan uses an amplified signal from a photocell to activate a switch, which is assisted by an electromagnet, and which upon making contact activates a solenoid which, in turn, activates an electromechanical switch and activates (or deactivates) a light. By using a plurality of such solenoids and electromechanical switches, in conjunction with preset, increasing output levels of the photocell, Dewan increases the amount of artificial light when the light available from the natural sources decreases.

Should the photocell of Dewan's invention be suddenly be exposed to lightning, then most or all of the artificial lights would be momentarily turned off. They would, of course, go back on; but, during a protracted storm having a large amount of lightning, such results would be intolerable inasmuch as lights continuously turning on and off would seriously disrupt the organized workings of a modern office building. Another disadvantage of Dewan's invention is the relative unreliability of the relays and the electro-mechanical switches.

A prior art invention which addresses itself to the above-stated problems is that of the previously mentioned patent application of Lester J. Owens. Owens discloses apparatus for combining solar light with artificial light to maintain a desired level of illumination within a structure. He uses a light sensor to control a bi-directional clock motor having mercury switches thereon to increasingly (or decreasingly) activate a plurality of lights associated therewith. Owen's solution to making the apparatus insensitive to lightning, is the inherent slow response time of the motor due to its slow rotational speed. When the motor rotates, a plate having mercury switches thereon also rotates. In this manner, the mercury switches progressively close and lights connected to the switches progressively turn on. Thus, although Owens directly addresses the problem, he still relies upon mechanical devices to achieve the result.

In conclusion, the prior art does not disclose any apparatus or system which is economical, reliable or precise.

SUMMARY OF THE INVENTION

The present invention overcomes the problems of the prior art by disclosing completely electronic apparatus which maintains the light level in a room by a combination of artificial and natural light and is not sensitive to sudden, abrupt changes in the natural light as might be caused by a lightning storm, a shadow of a person passing by or the like.

The apparatus includes a photo-sensitive cell which generates either increased or decreased resistance depending upon the light available to it. The change in resistance results in a corresponding change in voltage which is input to a comparator. This change in voltage causes the comparator, acting as a gate, to close one of two gates, which in turn inputs voltage to a pulse generator. This sets the timing feature of the apparatus in motion by transmitting voltage impulses from the pulse generator to a shift register. Upon receiving a timed voltage impulse from the pulse generator and in conjunction with receiving a simultaneous positive or negative voltage from the comparator, the shift register activates switching apparatus consisting of triacs, SCRs or thyristors and in turn activates preselected banks of artificial lights, either turning them on or off until a predetermined level of light intensity is achieved. When this occurs, the circuit remains at idle until a differential in the light intensity is received by the photocell and the circuit is again activated.

Accordingly, it is an important object of the present invention to provide light-control apparatus for interior lighting which efficiently supplements natural light with artificial light to maintain a desired level of light illumination.

Another important object of the present invention is to provide reliable apparatus for supplementing natural light with artificial light and whereby an instantaneous but erroneous difference in light intensity such as that caused by lightning or a passing shadow does not cause a resulting change in the level of the interior lighting.

Yet another important object of the present invention is to provide apparatus which is totally electronic in combining artificial light with available natural light to maintain a desired level of interior lighting.

Yet another important object of the present invention is to provide apparatus which is both small and economical in combining artificial light with available natural light to maintain a desired level of interior lighting.

Still another important object of the present invention is to provide apparatus to combine natural light with artificial light which is sufficiently versatile so that all of the above objects are achieved and so that a large number of individual artificial lights can be individually controlled thereby.

Still another important object of the present invention is to provide apparatus to combine natural light with artificial light to conserve electrical energy.

The present invention will be better understood and further objects and important features other than those specifically noted above will become apparent when consideration is given to the following details and description, which when taken in conjunction with the drawings, describes, discloses, illustrates and shows preferred embodiments or modifications of the present invention and what is considered and believed to be the best modes of practicing the principles thereof.

BRIEF DESCRIPTION OF THE DRAWINGS

For a fuller understanding of the invention, reference is had to the following description taken in connection with the accompanying drawings, in which.

DESCRIPTION OF THE PREFERRED EMBODIMENTS

Figure 2:
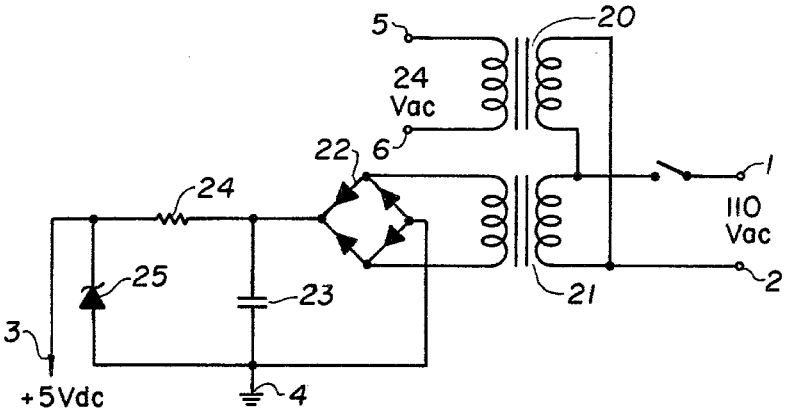
FIG. 2 shows a circuit to produce the power sources required by FIG. 1.

Referring now to the drawings in detail, in FIG. 2, input terminals 1 and 2 are intended to be connected to a supply voltage of, for example, 110 V, 60 Hz. This voltage is then converted into 24 VAC by transformer 20 which voltage is output at terminals 5 and 6. Similarly, the 120 VAC is converted into 5 VDC (stabilized) at terminals 3 and 4 by transformer 21 and rectifier 22, capacitor 23, resistor 24 and Zener diode 25.

Figure 1:
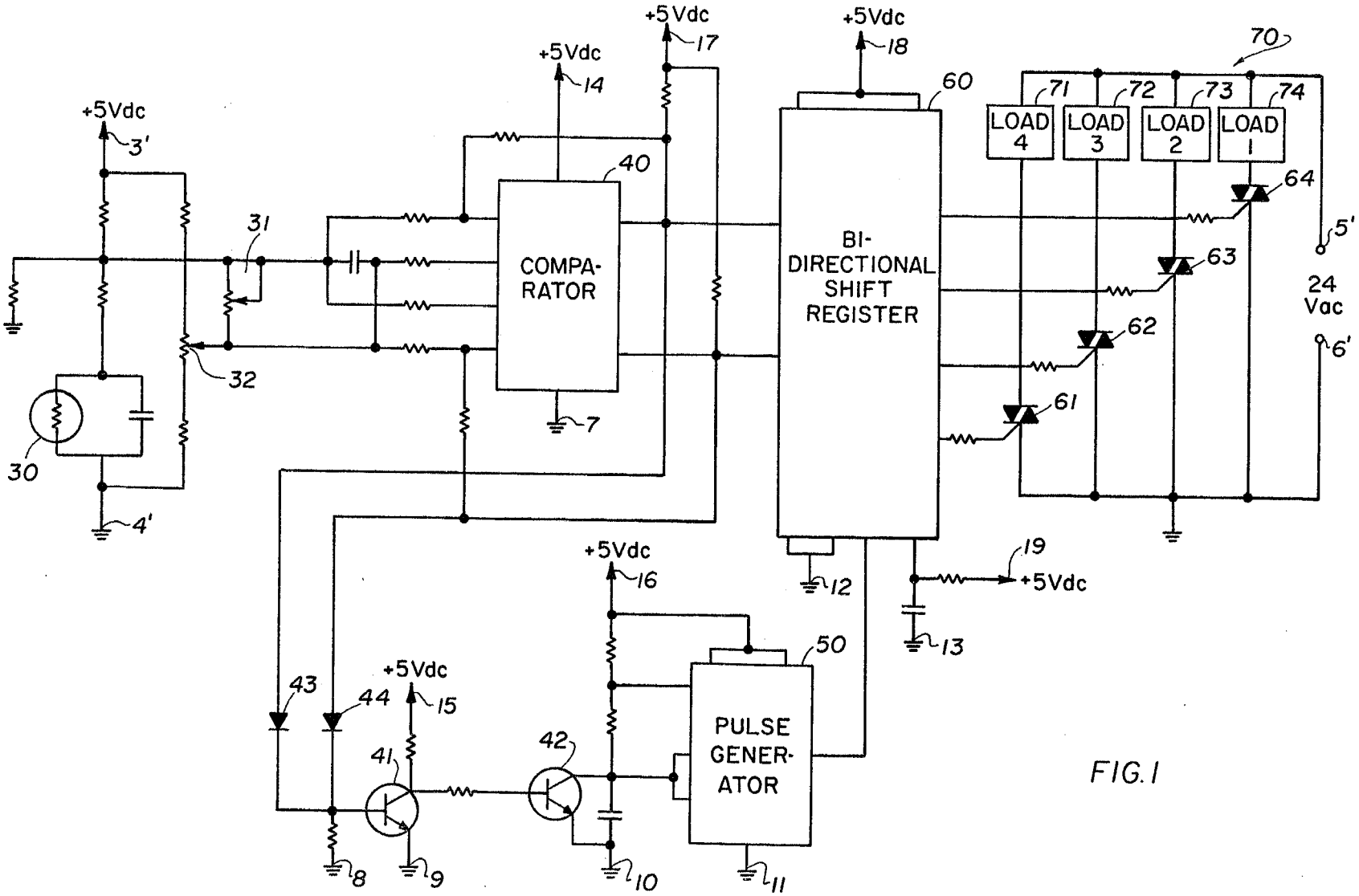
FIG. 1 shows an electric circuit diagram of one embodiment according to the invention.

As shown in FIG. 1, the 5 VDC supply is input across terminals 3' and 4' of the photocell 30. For drawing convenience and simplification of the drawing, terminals 7 through 13 inclusive are shown to be individually connected to ground. Similarly, terminals 14 through 19 are shown with an arrow and a +5 VDC indicating that they individually connected to the 5 VDC source. In actuality, terminals 7 through 13 and 14 through 19 may be commonly connected and to terminals 4' and 3', respectively.

Photocell 30 is of the active type in that it is resistive to the 5 VDC potential applied across the photocell 30 and therefore opposes current flow therethrough. By providing an adjustably potentiometer or a light level controller designated as item number 32, the photocell 30 is capable of being calibrated to allow the selection of a desired level of light illumination. Another controller consisting of an adjustable potentiometer 31 allows an adjustment to the range between which the photocell 30 activates the artificial lights. For example, control 31 can be used to set the level of illumination at 125 lumens; then, control 32 may be set for ±5 lumens. In this way, the area to be lighted by a combination of natural and artificial light will be maintained at a desired level of 125 lumens and when the light level decreases to 120 lumens, the photocell 30 activates the circuit to increase the artificial light. Conversely, if the natural light level increases so that the total light level is 130 lumens, the photocell again activates the circuit to decrease the amount of artificial light being used.

Comparitor 40 not only compares the level of current and therefore voltage output from photocell 30 with a known value, but also distinguishes the amount of the difference between the output and the known value. In this regard, comparitor 40 may be classified as the anolog type.

Comparitor 40 contains two gates (not shown) both of which are normally open when the system is activated but the system is sitting at an idle. That is, when there is no demand for either an increase or decrease in the level of illumination. One of the gates responds to a decrease in the level of light as sensed by photocell 30 while the other gate responds to an increase in the level of light as sensed by photocell 30. In either case, however, the response of the particular gate is to close thereby allowing current to flow therethrough and to be input to the shift register 60.

As shown in FIG. 1, the output from the comparitor 40 is also directed to the pulse generator 50. Upon receipt of the signal from comparitor 40, pulse generator 50 begins to pulse sending timed pulses of voltage to shift register 60. In the example shown, shift register 60 has now received a 2.5 volt potential from comparitor 40 and a 2.5 volt potential from pulse generator 50, this causes shift register 60 to either decrease or increase the level of artificial light which is schematically illustrated in FIG. 1 by numeral 70. Shift register 60 causes an increase in the level of artificial light when it receives the input voltage from the gate within comparitor 40 which corresponds to the signal from photocell 30 indicating increased artificial light intensity is demanded. For purposes of this specification, the gate just described will hereinafter be referred to as the increase gate, while the other gate will be hereinafter referred to as the decrease gate. Hence, when shift register 60 receives the voltage transmitted by the decrease gate and the pulsed voltage from pulse generator 50, it operates to decrease the artificial light. Conversely, when shift register 60 receives the voltage transmitted by the increase gate and the pulsed voltage from pulse generator 50, it operates to increase the artificial light.

Pulse generator 50 is utilized to establish a time delay, which preferentially is between five and fifteen seconds, to prevent the system from hunting to establish the desired level of light illumination and to eliminate instantaneous passing conditions such as lightning or a shadow created by the body of a person passing by from falsely deactivating or activating the artificial lights which otherwise would automatically and undesirably compensate for the abrupt changes in the level of illumination. The signal input to pulse generator 50 is amplified by a pair of transistors 41 and 42 arranged in piggyback fashion. Diodes 43 and 44 are appropriately positioned in the circuit ahead of transistors 41 and 42 to prevent backflow of current.

Still referring to FIG. 1, a four bit bi-directional shift register 60 is provided in conjunction with comparitor 40 and pulse generator 50. The shift register, upon being impulsed, by voltage impulses from pulse generator 50 activates one of four thyristors numbered 61, 62, 63 and 64. In place of thyristors, either triacs, SCRs or relays may be used. Shift register 60 is bi-directional in that it will transmit either a negative potential or a positive potential to thyristors 61, 62, 63 and 64.

In the illustrated example, light 71 will always be activated before light 72 which will be activated before light 73 and so on. Conversely, light 74 must be shut off before light 73 is shut off, etc. Thus, lights 71 through 74 are sequentially turned on and off. For example, assuming that light 73 is on, the system is responsive to an increase or decrease in the amount of natural light and will either turn light 72 off or light 74 on as the demand for less or more light indicates.

The sequencing described above is accomplished by shift register 60. For example, assuming lights 71 and 72 are on and 73 and 74 are off. When photocell 30 senses a decrease in the level of natural lights, it signals comparitor 40 within which the increase gate closes sending a positive potential to shift register 60. As previously described, pulse generator 50 also sends timed voltage pulses to shift register 60. Shift register 60 then transmits a positive potential to thyristor 63 which causes thyristor 63 to close, thereby turning light 73 on.

Assuming the same equilibrium condition as previous but now there is an increase in the level of natural light. Photocell 30 senses this increase and transmits the signal to comparitor 40. The decrease gate in comparitor 40 closes, sending a negative potential to shift register 60. Shift register 60 reacts to the negative potential and the time delayed voltage pulsed by pulse generator 50 by sending a negative potential to thyristor 62 causing it to open and shut off light 72.

Figure 3:
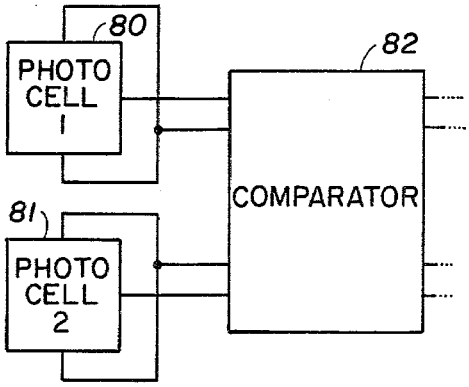
FIG. 3 shows a second arrangement of the invention whereby two photo-sensing devices are used either jointly or severally to control the embodiment of FIG. 1.

It will be appreciated that the above-described system is arranged to activate up to four individual lights or banks of lights and that only one photocell is used. In FIG. 3, two separate photocells, 80 and 81, respectively, are connected to a comparitor 82 having an appropriate number of input lines. The output pins of the comparitor 82 may be individually utilized or coupled together. If individually used, then two of these may be connected to one shift register (not shown) and the remaining two to another shift register (not shown). In this manner, the system may be used to activate a larger number of individual lights or banks of lights than previously mentioned. Alternatively, if the output pins of comparitor 82 are coupled together to result in a total of two output lines (as shown by the dotted lines) the photocells 80 and 81 both control the comparitor output. In this manner, any one lower or higher reading of the photocells controls the banks of lights. Even more photocells may be similarly employed to achieve an even further increase in the degree or refinement of control.

Figure 4:
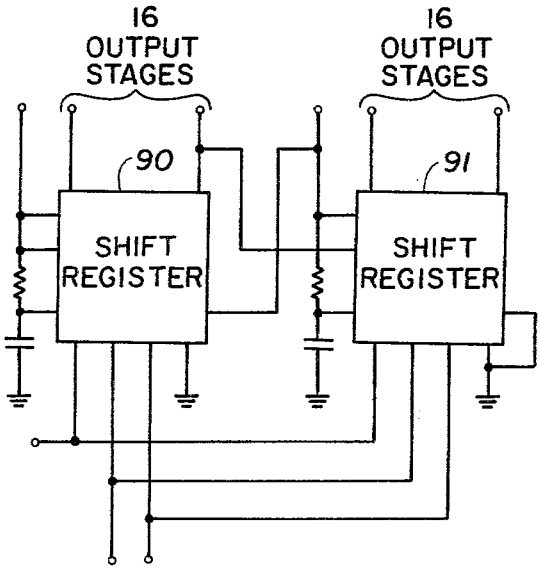
FIG. 4 shows an arrangement whereby a number of shift registers are controlled; and, FIG. 5 shows an arrangement of lights in a room controlled by circuit of FIG. 1 including a second shift register.

In FIG. 4, the output signal from a comparitor is input to a first shift register 90 and a second shift register 91. In this figure, each shift register has the capability of controlling sixteen output stages or lights. To control an even larger number of output stages, additional shift registers may be similarly connected to each other and/or shift registers having a greater number of output stages may be used.

Thus, by appropriately connecting a number of photocells, one or more comparitors, and a number of high output shift registers, along with one or more pulse generators as taught by this specification, a system is obtained whereby a very large number of individual or banks of lights may be activated with a highly precise degree of light level control and one which is virtually insensitive to rapid transient changes in the actual level of natural light or in a false or erroneous level of light as sensed by appropriate sensing devices. Such a system has readily apparent advantages resulting in very gradual changes in light level and even greater savings in electrical energy. Also, such a system is much more versatile in that the increased number of combinations that can be achieved can more effectively be used where the interior space is divided by room dividers or where the building itself and the windows therein are oriented for reasons other than for the maximum utilization of natural light from solar energy. By similar reasoning, the control of an even greater number of lights or banks of lights as is possible by extrapolation of the teachings of this invention would result in even more versatility, preciseness of control and energy savings.

Figure 5:
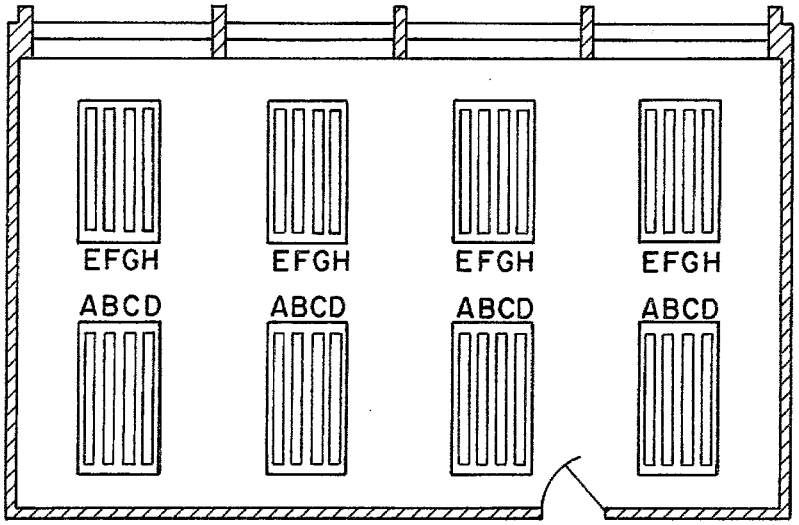

FIG. 5 shows an arrangement whereby the lights in a room are controlled by the system shown utilizing two shift registers each controlling four banks of lights, lights A and E, B and F, C and G, and D and H are always operated together. It will be realized that FIG. 5 shows only one arrangement of lights and that many more arrangements can be set up and tailored for individual rooms regardless of size. It will also be realized that even more individual lights and banks of lights can be added to the circuit controlled by the single photocell by simply adding additional shift registers in the manner illustrated in FIG. 4. The number of lights that are capable of being controlled and the number of arrangements are virtually limitless.

While the invention has been described, disclosed, illustrated and shown in certain terms or certain embodiments or modifications which it has assumed in practice, the scope of the invention is not intended to be nor should it be deemed to be limited thereby and such other modifications or embodiments as may be suggested by the teachings herein are particularly reserved especially as they fall within the breadth and scope of the claims here appended.

We claim:

1. Illumination control apparatus for combining artificial light with light from natural sources comprising
- one or more artificial devices connected to a power source,
- electronic switching means operatively connected to said one or more light devices for switching said light device on and off,
- light sensor means operatively connected to said switching means for controlling said switching means by sensing the level of illumination in a room,
- electronic timing means operatively connected to said light sensor means and said switching means for delaying for a preset period of time the operation of said switching means,
- comparitor means connected between said switching means and said light sensor means for receiving a signal from said light sensor means and activating said switching means to increase or decrease the level of artificial light so as to maintain a substantially constant preset level of illumination in said room for a combination of natural light and said artificial light,
- means for activating said switching means to sequentially turn on or turn off said one or more light devices, said sequential activating means being operatively connected between said comparitor means and said switching means and being operatively connected to said timing means such that said switching means is activated by a combination of signals from said comparitor means and said timing means.

2. The apparatus of claim 1, wherein said one or more light devices are connected to a power source comprising alternating current and said electronic switching means are connected to a power source comprising direct current.

3. The apparatus of claim 1, wherein said sequential activating means comprises a shift register.

4. The apparatus of claim 1, including a first control means operatively connected to said light sensor means for setting a desired level of illumination which is to be maintained within a room and including a second control means operatively connected to said light sensor means for setting an illumination range above and below said desired level of illumination such that when the illumination within a room drops to said illumination level below said desired level then said illumination control apparatus functions to increase the artificial light and when the illumination within a room raises to said illumination level above said desired level then said illumination control apparatus functions to decrease the artificial light.

5. The apparatus of claim 5, including a third electrical power source comprising alternating current, said third power source being of a voltage higher than said first power source and higher than said second power source and transformer means connected between said first and third power sources and between said second and third power source for lowering the voltage of said first and said second power sources.

6. The apparatus of claim 5, wherein said first electrical power source comprises approximately 24 volts AC, said second electrical power source comprises approximately 5 volts DC, and said third electrical power source comprises approximately 120 volts AC.

7. The apparatus of claim 1, wherein said electronic timing means comprises a pulse generator which is operatively connected to the output side of said comparitor means and is operatively connected to the input side of said sequential activating means.

8. The apparatus of claim 7, wherein said pulse generator emits pulsed voltages of approximately 2.5 volts DC to said sequential activating means.

9. The apparatus of claim 1, wherein said comparitor means includes two gating circuits which are normally open, one of said gating circuits being closed when said light sensing means senses a decrease in the preset level of illumination and the other gating circuit being closed when said light sensing means senses an increase in the preset level of illumination.

10. The apparatus of claim 3, wherein said shift register means comprises a first shift register and a second shift register, each of said two shift registers being operatively connected in parallel with said comparitor means and in parallel with said timing means, said first shift register being operatively connected with first switching means and said second shift register being operatively connected with second switching means.

11. The apparatus of claim 1, wherein said light sensor means comprises at least two light sensors each being separately connected to said comparitor means, whereby the output of said comparitor means is controlled by either of said light sensors.

* * * * *